US008439747B2

(12) United States Patent
Pincus et al.

(10) Patent No.: US 8,439,747 B2
(45) **Date of Patent: *May 14, 2013**

(54) VIRTUAL PLAYING CHIPS IN A MULTIUSER ONLINE GAME NETWORK

(75) Inventors: Mark Jonathan Pincus, San Francisco, CA (US); Michael Arieh Luxton, Sunnyvale, CA (US); Matthew Adam Ocko, Palo Alto, CA (US); Carl Eric Schiermeyer, Burlingame, CA (US); Stephen Henry Schoettler, Menlo Park, CA (US)

(73) Assignee: Zynga Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/244,702

(22) Filed: Sep. 26, 2011

(65) Prior Publication Data

US 2012/0015715 A1 Jan. 19, 2012

Related U.S. Application Data

(63) Continuation of application No. 12/716,573, filed on Mar. 3, 2010.

(60) Provisional application No. 61/158,246, filed on Mar. 6, 2009.

(51) Int. Cl.
*G07F 17/32* (2006.01)

(52) U.S. Cl.
USPC ..... 463/25

(58) Field of Classification Search ..... None
See application file for complete search history.

(56) References Cited

U.S. PATENT DOCUMENTS

| | | | | |
|---|---|---|---|---|
| 6,229,533 | B1 * | 5/2001 | Farmer et al. | 345/473 |
| 6,302,793 | B1 * | 10/2001 | Fertitta et al. | 463/25 |
| 7,128,652 | B1 * | 10/2006 | Lavoie et al. | 463/42 |
| 7,867,082 | B2 * | 1/2011 | Vali-Tepper | 463/25 |
| 2004/0006531 | A1 * | 1/2004 | Kwan | 705/37 |
| 2006/0080613 | A1 * | 4/2006 | Savant | 715/745 |
| 2007/0197280 | A1 * | 8/2007 | Vali-Tepper | 463/25 |
| 2008/0026827 | A1 * | 1/2008 | Skotarczak et al. | 463/25 |
| 2008/0086759 | A1 * | 4/2008 | Colson | 726/2 |
| 2008/0090632 | A1 * | 4/2008 | Kumar | 463/16 |
| 2008/0113773 | A1 * | 5/2008 | Johnson et al. | 463/25 |
| 2009/0121434 | A1 * | 5/2009 | Baerlocher et al. | 273/292 |
| 2010/0062840 | A1 * | 3/2010 | Herrmann | 463/25 |

(Continued)

OTHER PUBLICATIONS

Shukla, Anu. "Beyond Facebook Gifts: Virtual Currencies 101". Dec. 18, 2008. <http://mashable.com/2008/12/18/virtual-currency/>.*

(Continued)

*Primary Examiner* — Melba Bumgarner
*Assistant Examiner* — Seng Heng Lim
(74) *Attorney, Agent, or Firm* — Martine Penilla Group, LLP

(57) ABSTRACT

Methods, systems, and computer programs are presented for executing game transactions in an online game to acquire virtual currency. One method includes an operation for detecting a request from a player to purchase virtual currency for use in the online game. Cash or credit is received, in an online transaction, to make the purchase of the virtual currency. The virtual currency of the online game is not redeemable for cash or credit so the virtual currency cannot be considered gambling proceeds. The method further includes an operation for crediting the player with an amount of virtual currency based on the amount of the received cash or credit.

15 Claims, 11 Drawing Sheets

U.S. PATENT DOCUMENTS

| | | | | |
|---|---|---|---|---|
| 2010/0248823 | A1* | 9/2010 | Smith | 463/29 |
| 2011/0045898 | A1* | 2/2011 | Anderson | 463/25 |
| 2011/0151976 | A1* | 6/2011 | Holloway et al. | 463/42 |
| 2011/0183749 | A1* | 7/2011 | Allen et al. | 463/25 |
| 2011/0207525 | A1* | 8/2011 | Allen et al. | 463/25 |

OTHER PUBLICATIONS

Croll, Alistair. "Can uJogo Make Money with Free Online Poker?". Jan. 22, 2008. <http://gigaom.com/2008/01/22/can-ujogo-make-money-offering-free-gambling/>.*

TripleJack. Dec. 2006. < http://jayisgames.com/tag/texasholdem>.*

Jay. "TripleJack". Dec. 2006. < http://jayisgames.com/archives/2006/12/triple_jack.php>.*

Haley Hintze. "World Poker Tour Launches Dedicated ClubWPT Myspace Channel". Oct. 21, 2008. <http://www.pokernews.com/news/2008/10/poker-wpt-myspace-announce-new-clubwpt-community-channel.htm>.*

* cited by examiner

VIRTUAL PLAYING CHIPS IN A MULTIUSER ONLINE GAME NETWORK

CLAIM OF PRIORITY

This application is a Continuation Application under 35 USC §120 and claims priority from U.S. application Ser. No. 12/716,573, entitled "Virtual Playing Chips in a Multiuser Online Game Network," and filed on Mar. 3, 2010, which claims priority to U.S. Provisional Application No. 61/158,246, filed Mar. 6, 2009, all of which are incorporated herein by reference for all purposes.

BACKGROUND

1. Field of the Invention

The present disclosure relates to multiuser online games in general, and in particular to games that track a store of in-game value for players.

2. Description of the Related Art

Multiuser online games are popular and are well-known in the art. In some implementations, there is a server that controls aspects of the game, such as who can become a player (i.e., a user that connects via a client device, computer or system to the server), the player's sensory inputs, player state (e.g., what virtual items the player's character possesses, what the character has done in the past, etc.), and player options (e.g., what the player or his character can do in the future).

Some multiuser online games are styled as, or after, casino gambling games (e.g., poker, roulette, slot machines, etc.). In a gambling game, players generally obtain virtual currency for their character's use in the gambling game. In some gambling games, players purchase virtual currency in exchange for legal currency, where the legal currency is transferred using a credit/debit/charge card transaction conveyed over a financial network. In such games, the virtual currency might be represented by virtual poker chips or by a number or value stored by the server for that player's benefit. A player would then interact with the game server such that the player (or a character controlled by the player) plays a gambling game in hopes of increasing the amount of virtual currency the character has so that the player can then "cash out" and receive, from the operator of the gambling game server, real-world currency corresponding to the gains that player made in the online gambling game.

Aside from the online aspect of this, such interactions are similar to a conventional casino transaction, wherein a player enters a casino, converts real-world currency (cash, check, credit card transaction) into chips, plays gambling games with those chips and cashes in those chips for real-world currency. Of course, with actual casinos and online casinos, activities are regulated by law and banned in certain jurisdictions.

There are online games that have virtual currency that is earned by taking actions in the game. For example, a dragon fighting game might reward 10 gold coins each time a dragon is successfully stayed. Some virtual-to-real economies have developed around the real-world sale and purchase of game items. For example, where a desired level, access, right, or item in an online game is a reward for many hours of playing the game and someone desires to obtain that without playing the game for hours, they might enter into a transaction with someone willing to sell that right. For example, a player having virtual goods he wants to sell might list those on an online auction site, and then agree to an arrangement with a buyer to have funds transferred from the buyer to the player/seller, then have the player/seller's character in the game hand the items to the buyer's character in the game.

In the case of gambling-type games, the ability to simply "cash out" by selling to the game operator would, in many jurisdictions, constitute regulated (and possibly illegal) gambling. Furthermore, permitting one player to effectively "cash out" by selling to another player may also run afoul of gambling laws or regulations. Consequently, in some cases, players want to play gambling-style games, but without the regulated gambling aspects.

SUMMARY

Methods, systems, and computer programs are presented for executing game transactions in an online game to acquire virtual currency. In one embodiment, a method includes an operation for detecting a request from a player to purchase virtual currency for use in the online game. Cash or credit is received, in an online transaction, to make the purchase of the virtual currency. The virtual currency of the online game is not redeemable for cash or credit so the virtual currency cannot be considered gambling proceeds. The method further includes an operation for crediting the player with an amount of virtual currency based on the amount of the received cash or credit. At least one operation of the method is executed through a processor. In another embodiment, a computer program embedded in a non-transitory computer-readable storage medium, when executed by one or more processors, executes the operations of the method.

In yet another embodiment, a method for executing game transactions in an online game includes an operation for receiving, from a first player, cash or credit in an online transaction to make a purchase of virtual currency for use in the online game. The virtual currency of the online game is not transferable to be considered gambling proceeds. In addition, the first player is credited with an amount of virtual currency based on the amount of the received cash or credit. The method further includes an operation for transferring an amount of virtual currency in the online game from the first player to a second player, wherein the transferring is limited to players connected to the first player in an online social network. At least one operation of the method is executed through a processor.

Other aspects will become apparent from the following detailed description, taken in conjunction with the accompanying drawings.

BRIEF DESCRIPTION OF THE DRAWINGS

The invention may best be understood by reference to the following description taken in conjunction with the accompanying drawings.

DETAILED DESCRIPTION

Figure 1:
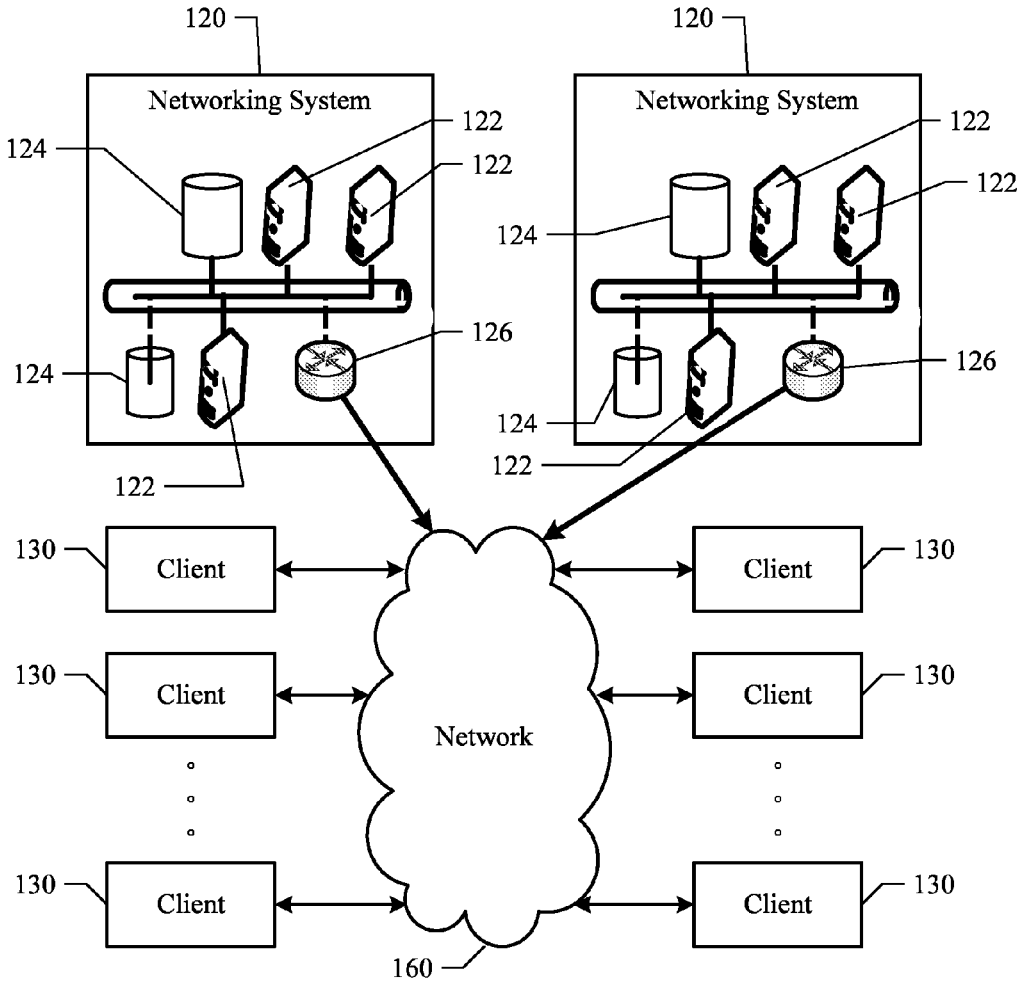
FIG. 1 illustrates an example network environment.

The Applicants formally retract the arguments made in the parent application, as the parent application presented claim language that may have been narrower or different than what is being presented in this present application. For this reason, the Examiner is respectfully requested to review each of the claim elements in this continuation application anew and also reconsider each of the prior art references considered during the prosecution of the parent application as they may apply differently to what is claimed in this continuation application.

Non-Redeemable Virtual Currency

In embodiments of a multiplayer online game system, players within the game can acquire virtual currency. Such virtual currency represents units of value for use in the online game system, and is analogous to legal currency. Virtual currency can be purchased in one or more actual cash or credit transactions by a player. However, the virtual currency cannot be redeemed for legal currency. Consequently, the purchase is a one-way transaction that provides a benefit to the purchaser only in the context of the virtual environment. Virtual currency can also be earned within the context of the game. For example, a player may be rewarded with one or more units of virtual currency after completing a task, quest, challenge, or mission within the game. One advantage of the approached described herein is that virtual currency can be used to purchase virtual items, but neither the virtual currency nor the virtual items can be transferred or redeemed in such a way that would be considered gambling proceeds.

Virtual currency can be used in multiplayer online games accessed via social networking servers. For example, social games such as Zynga Poker and Farmville offered by Zynga Game Network, Inc. of San Francisco, Calif. are examples of such games. In order to prevent fraud or other terms of service violations (e.g., the exchange of virtual currency for legal currency between players), a fraud detection system can be used to block such consummations, thereby defeating the market for secret transactions.

Non-Redeemable Virtual Poker Chips

In some embodiments, non-redeemable virtual currency is represented by virtual poker chips. Virtual poker chips are units of value for use in a virtual online multiplayer poker game. Within the context of a multiplayer online poker game, virtual poker chips are analogous to real world poker chips. Virtual poker chips can be purchased in one or more actual cash or credit transactions by a player of such virtual poker game, as well as acquired from other parties by winning a hand in such virtual poker game or playing other games against other players (or between the players' characters in the game). Virtual poker chips can be used within the context of the virtual poker game to purchase virtual items. For example, a player can buy virtual drinks or other items for one or more other players to support their online social activities. However, unlike real world poker chips, virtual poker chips are not redeemable for legal currency. Similarly, virtual items purchased with virtual poker chips are not redeemable for legal currency.

In some embodiments, the virtual poker chips can have a unique game play mechanism. In one example embodiment, a first player can make transfers or gifts of virtual poker chips to a second player. However, to prevent fraud or other terms of service violations (e.g., the transfer of legal currency between players outside the context of the virtual poker game in exchange for the transfer of virtual poker chips within the virtual poker game), in-game transfers and gifts can be limited. These transfers and gifts can be limited in size (e.g., no more than 10,000 chips per transfer) and/or frequency (e.g., no more than one transfer per day). Furthermore, transfers can be limited to players who are friends or otherwise connected within the context of an online social network (e.g., transfers are only allowed between players who are also "friends" on Facebook®. Fraud detection systems can be used to prevent fraudulent transactions.

In another example embodiment, certain levels of purchases of virtual poker chips can correlate to the privilege to play with higher skilled or higher status players, not just players with similar amounts of chips. Thus, purchased virtual chips and won virtual chips might be treated differently and provide different access to the holder of such virtual chips. This mechanism allows new entrants to the game who are skilled in the real world or alternate online venues to play with players of similar skill without waiting to win multiple games/acquire status within the context of the virtual poker game. In another example, multiple types of virtual poker chips may be available for purchase from the game operator.

Some embodiments also include the use of virtual poker chips not just in poker, but in other online games as well, such as blackjack, keno and other casino-style gambling games.

Purchasing Non-Redeemable Virtual Poker Chips

Figure 3:
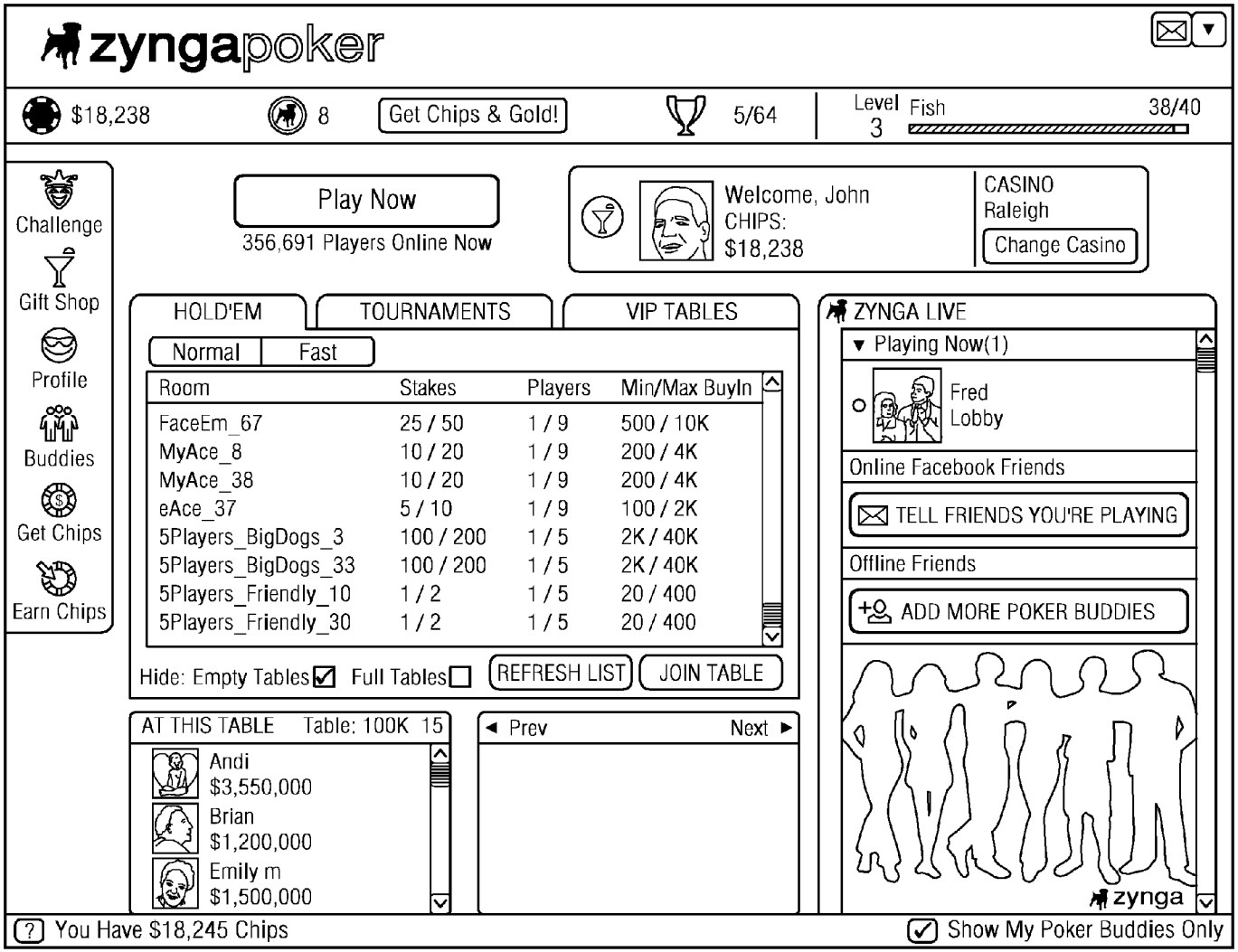
FIG. 3 is a schematic view of a webpage for accessing online virtual poker.
Figure 5:
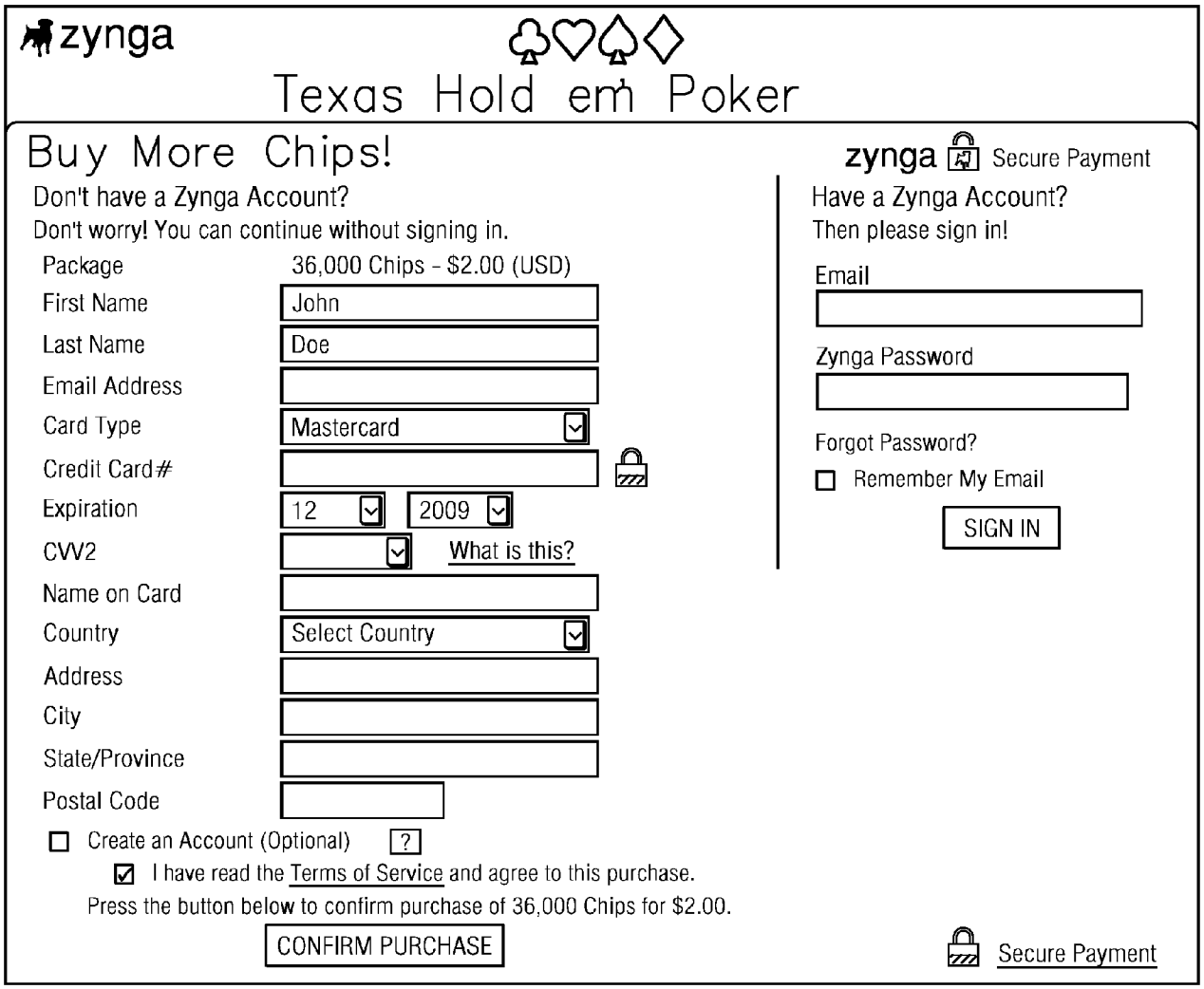
FIG. 5 is a schematic view of a webpage for inputting a player's personal and financial information.
Figure 6:
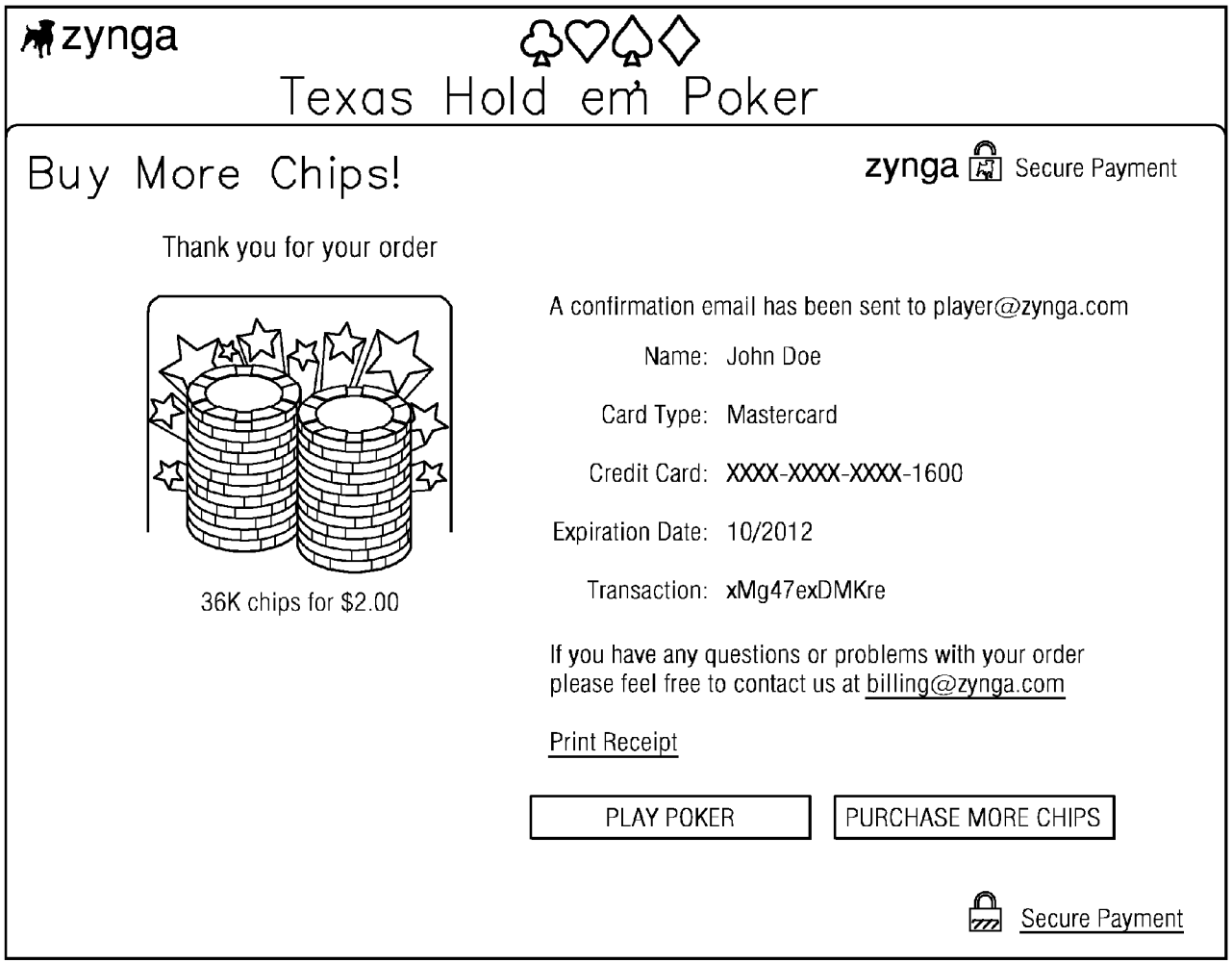
FIG. 6 is a schematic view of a webpage for confirming the purchase of virtual poker chips and the payment of legal currency.
Figure 7:
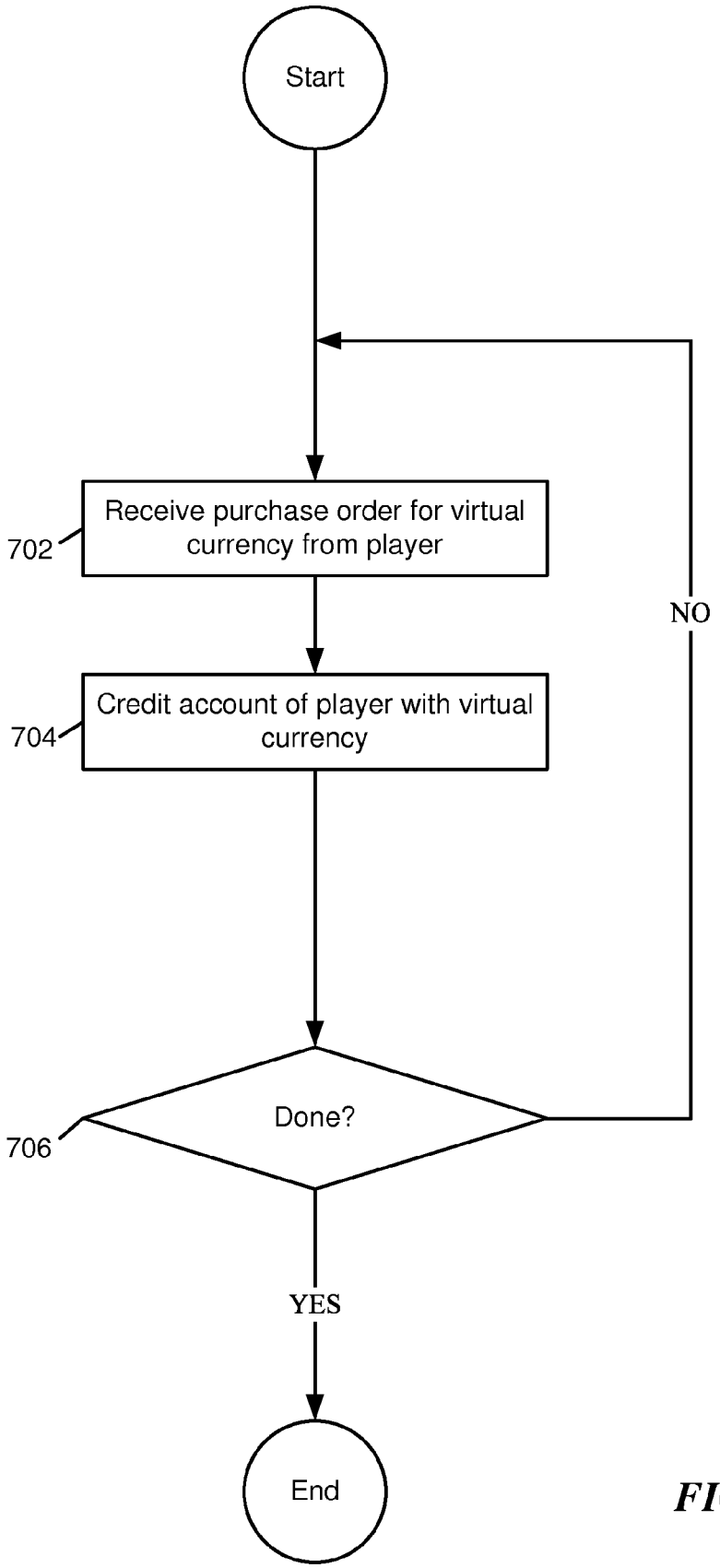
FIG. 7 shows a flowchart illustrating an example method for purchasing virtual currency.

In some embodiments, virtual poker chips can be purchased online One such embodiment is described in reference to FIGS. 3-7. FIG. 7 shows a flowchart illustrating an example method for purchasing virtual currency. FIG. 3 illustrates a webpage for accessing a fully operational online poker game according to embodiments of the present disclosure. This online poker game can either be accessed directly, or it can be embedded within the webpage of a social networking site. The illustrated page serves as a portal for accessing various features of the online poker game. In various embodiments, the website can include a hyperlink for accessing a webpage for purchasing virtual poker chips.

Figure 4:
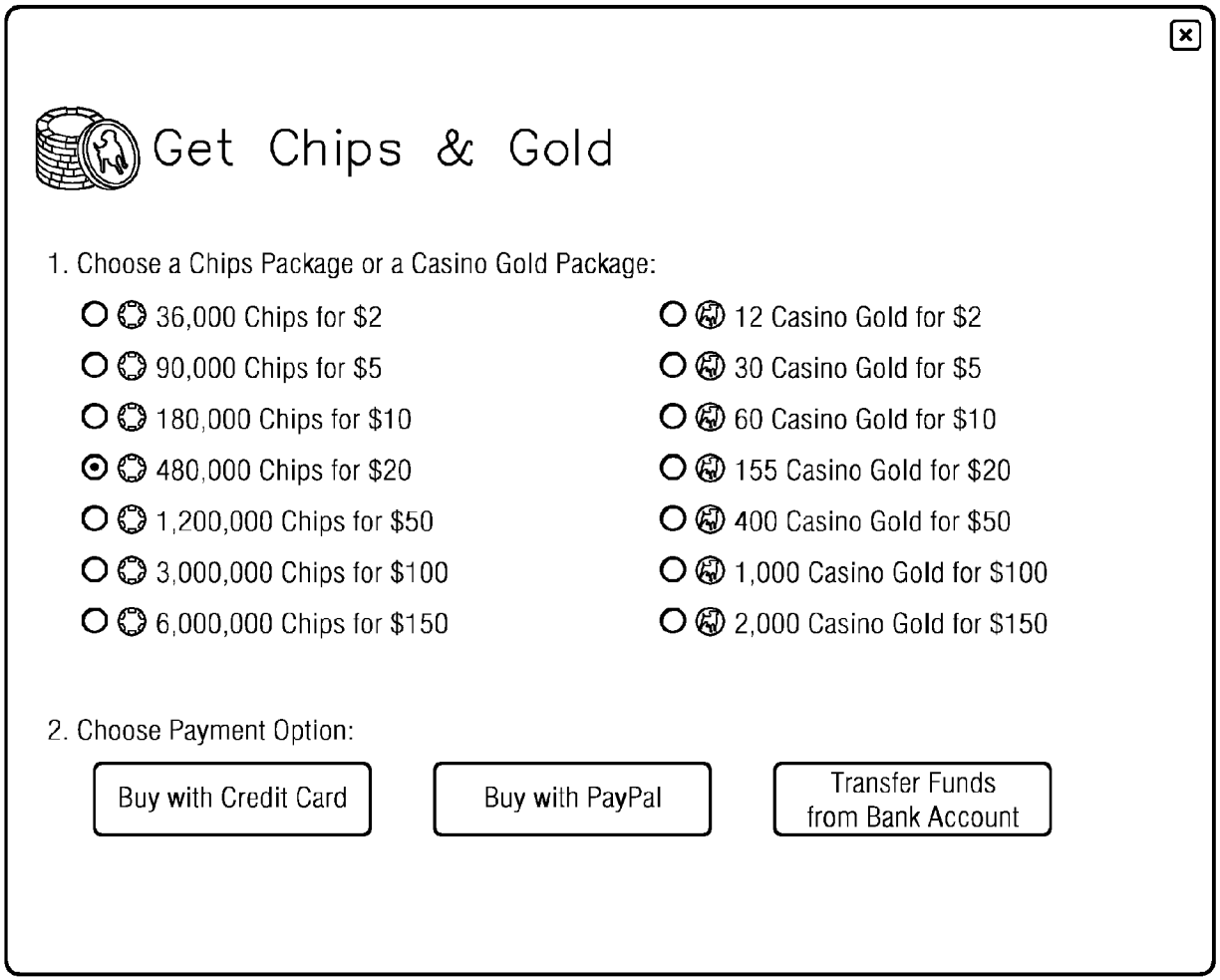
FIG. 4 is a schematic view of a webpage for selecting an amount of virtual currency to purchase.

FIG. 4 illustrates a webpage for purchasing virtual poker chips according to embodiments of the present disclosure. This page can be hosted by the online game server or another internet server. This page can include fields for selecting an amount of virtual poker chips to purchase and for selecting legal currency payment options (e.g., credit card, PayPal®, bank draft, ACH, etc.). Once the necessary selections are made, the webpage can take the player to another webpage on the same server or a separate server to complete the purchase.

FIG. 5 illustrates a webpage for inputting a player's personal and financial information to authorize the transfer of legal currency for the purchase of virtual poker chips according to embodiments of the present disclosure. This page can include fields for inputting a player's name, address, and credit card information. Alternatively, the player can already have a pre-established account where their personal and financial information is stored. Once the necessary information is inputted, the player can place the order to purchase virtual currency. This order is received by the server 702, which can then process the order. If the order is processed successfully, the player's game account can be credited with the amount of virtual poker chips ordered. For example, if the player uses a credit card account, the server may credit the users account with the amount of virtual chips ordered upon receiving the purchase order, receiving an authorization from a transaction processing network, or receiving final settlement of the funds.

FIG. 6 illustrates a webpage for confirming the purchase of virtual poker chips and the payment of legal currency. This page can include fields displaying the amount of legal currency the player has just paid and the amount of virtual poker chips the player has just purchased. This page can also include fields displaying the details of the legal currency payment method used and a confirmation number for the specific transaction. From this point, the player can choose to return to the virtual poker game or to purchase more virtual poker chips.

In some embodiments, a first player can make transfers or gifts of virtual items to a second player. However, to prevent fraud or other terms of service violations (e.g., the transfer of legal currency between players outside the context of the virtual poker game in exchange for the transfer of virtual items within the virtual poker game), in-game transfers and gifts can be limited. These transfers and gifts can be limited in size (e.g., no more than one item per transfer) and/or frequency (e.g., no more than one transfer per day). Furthermore, transfers can be limited to players who are friends or otherwise connected within the context of an online social network (e.g., transfers are only allowed between players who are also "friends" on Facebook®). For example, a game server, prior to allowing the gift or transfer, may access a social network to match the player wishing to gift an in-game value (e.g., currency, virtual objects, etc.) to another player. Social network platforms support APIs that allow for third-party applications to verify connections by providing one or more user identifiers associated with such players. Fraud detection systems can be used to prevent fraudulent transactions.

Purchasing Virtual Items with Virtual Poker Chips

Figure 8:
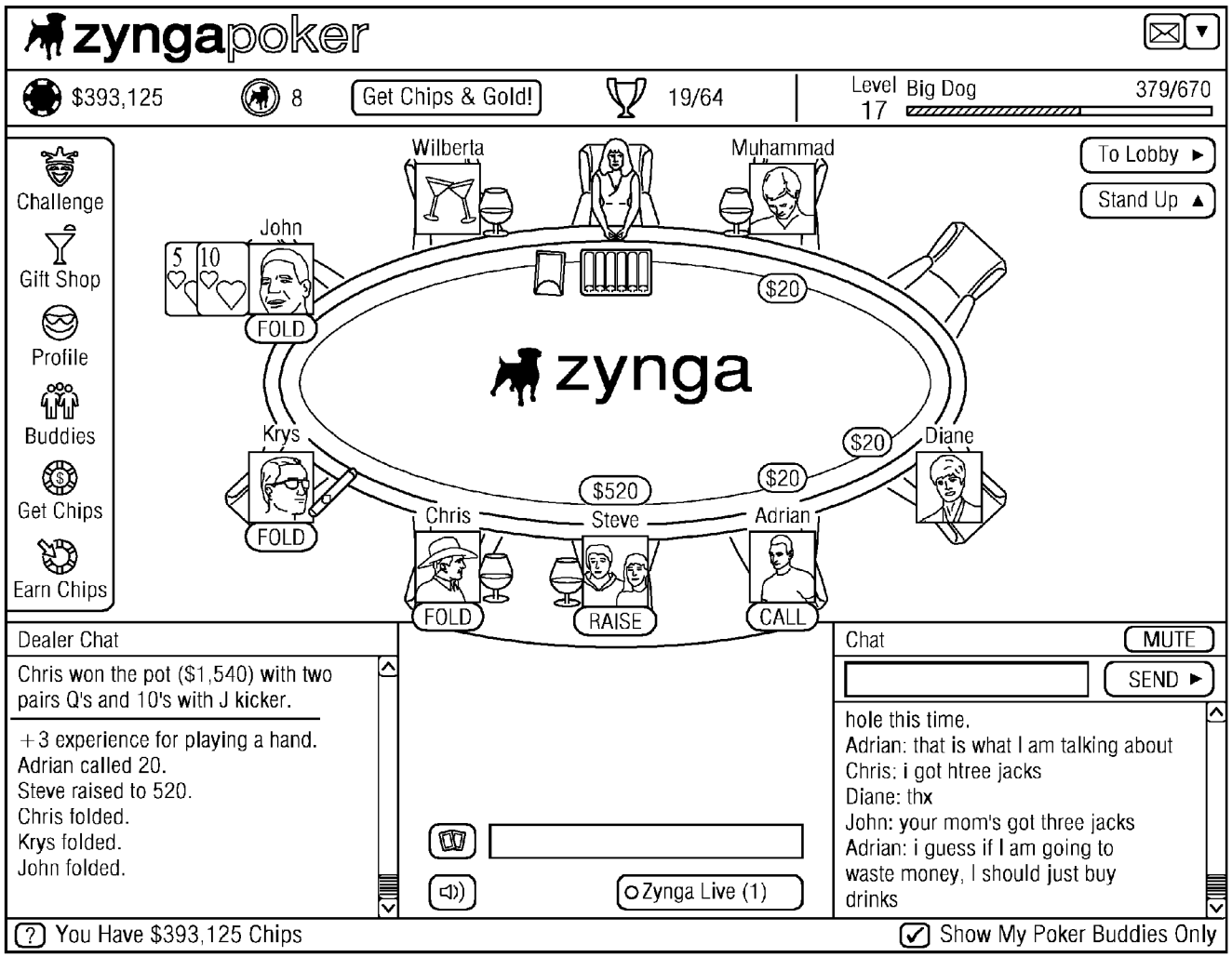
FIG. 8 is a schematic view of a webpage for playing online virtual poker with a plurality of players.
Figure 9:
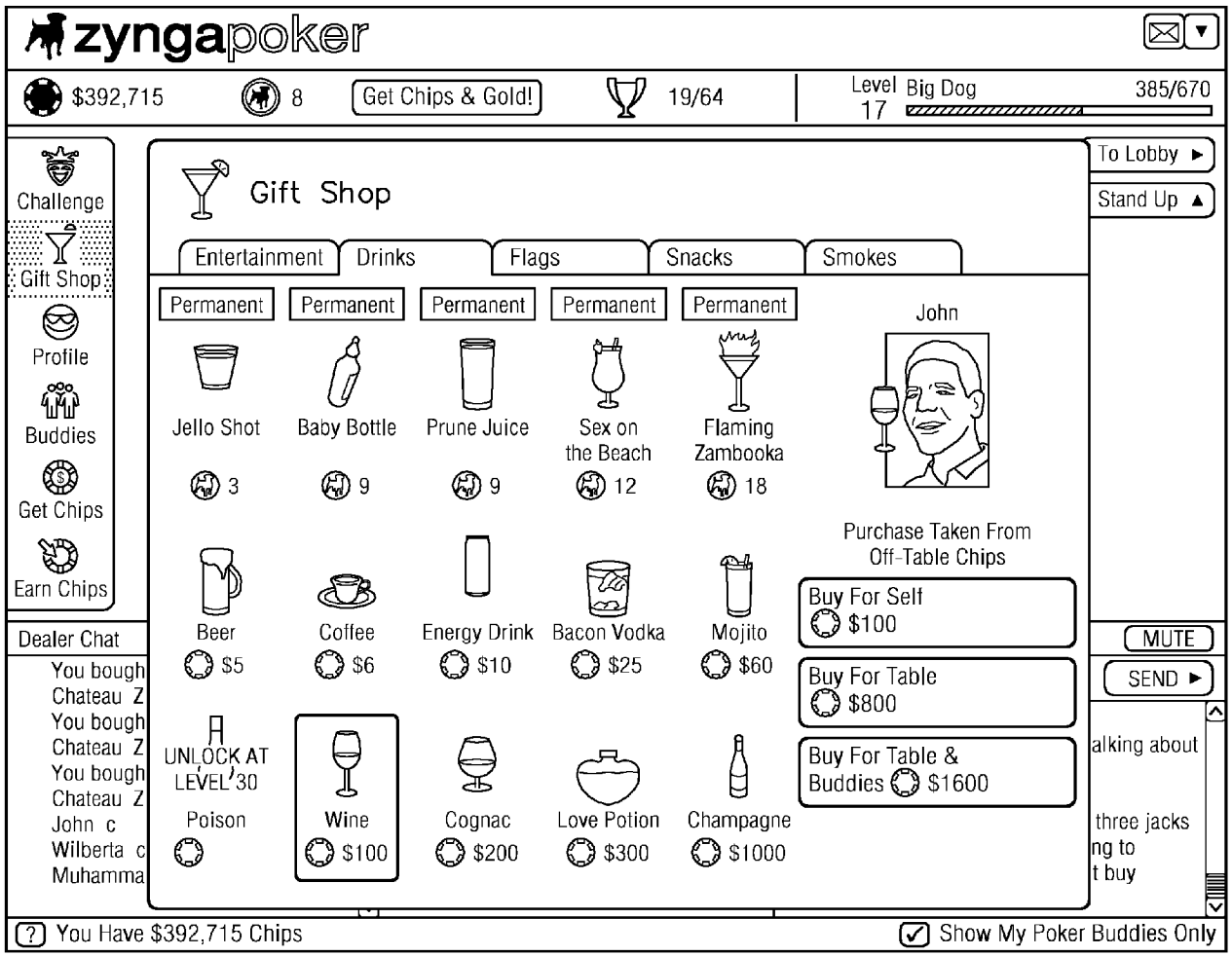
FIG. 9 is a schematic view of a webpage for selecting and purchasing virtual items with virtual currency.
Figure 10:
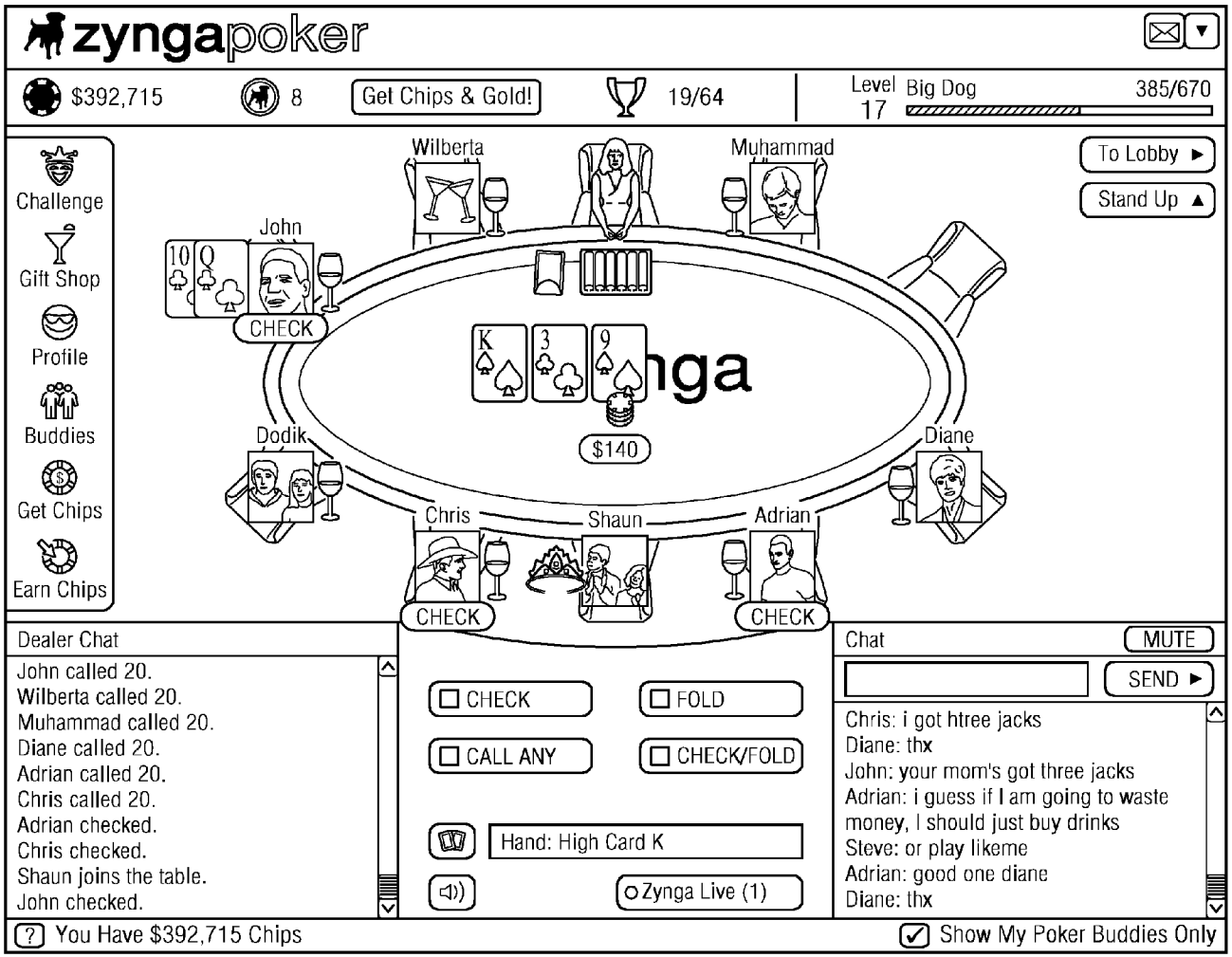
FIG. 10 is a schematic view of a webpage for playing online virtual poker wherein the players are associated with virtual items.
Figure 11:
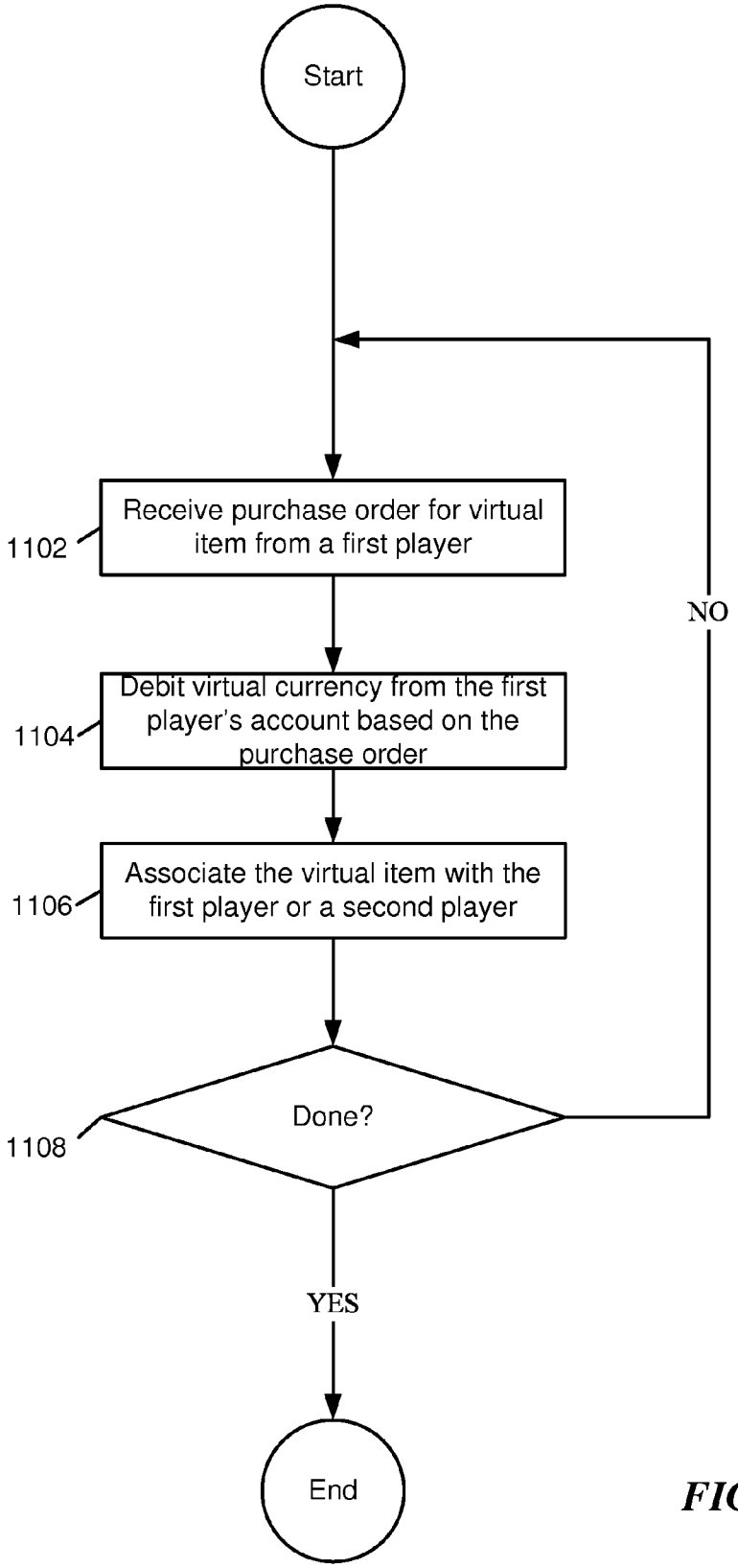
FIG. 11 shows a flowchart illustrating an example method for purchasing virtual items with virtual currency.

In some embodiments, virtual poker chips can be used to purchase virtual items online One such embodiment is described in reference to FIGS. 8-11. FIG. 11 shows a flowchart illustrating an example method for purchasing virtual items using virtual poker chips. FIG. 8 illustrates a webpage of a virtual online poker game with a plurality of players according to embodiments of the present disclosure. This online poker game can be accessed directly, or it can be embedded within the webpage of a social networking site. The illustrated page shows a virtual poker table, a virtual poker dealer, an icon of a first player and icons of a plurality of other players ("player icons"), the cards the first player is holding, the amount of virtual poker chips held by each player, the size of each player's bet, and the size of the pot for the current hand of poker. Associated with each player icon is an item icon where one or more virtual items associated with the player can be displayed. The page includes a separate hyperlink or other activatable user interface element for accessing a user interface for purchasing virtual items. In an alternative embodiment, the first player can access the user interface for purchasing virtual items by selecting the item icon for any player.

FIG. 9 illustrates a webpage where virtual items can be selected and purchased. The illustrated page shows a variety of virtual items that can be selected. Each virtual item displays the number of virtual poker chips needed to purchase it. Some virtual items can be purchased permanently, meaning the item stays associated with the player in perpetuity. Other items are not permanent when purchased, meaning the item stays associated with the player for a limited duration (e.g., the item stays associated with the player as long as he remains at that virtual poker table, or as long as the player remains logged in to the virtual poker game). In some embodiments, items can remain associated with a player across games (e.g., if a player buys a box of cigars in a virtual online poker game, such as Zynga Poker, that item can remain associated with the player if he/she logs into a virtual online role-playing game, such as Zynga Mafia Wars).

From the page illustrated in FIG. 9, a player can select an item to purchase. A player can also select whether to purchase the item for himself, or for one or more other players (e.g., the player can select to purchase the item for all players at the virtual poker table, or for the player's friends who are playing virtual poker at other virtual poker tables). Once the necessary selections are made, the player can place the order to purchase the virtual item. This order is received by the server 1102, which can then process the order. If the order is processed successfully, the player's game account can be debited by the amount of virtual poker chips needed to buy the virtual items selected 1104. In the example illustrated, the first player selected to purchase a glass of wine for each player at the table.

FIG. 10 illustrates the same virtual online poker game as illustrated in FIG. 8. Once a first player completes the purchase of a virtual item, the virtual item can then be associated with the first player or another player 1106. In the illustrated example, the amount of virtual poker chips held by the first player has been decremented, and each player at the virtual poker table now has a virtual glass of wine associated with them. From this point 1108, the player can choose to continue playing virtual poker or to purchase more virtual items.

Systems and Methods

In various example embodiments, one or more described webpages and functionality discussed above may be associated with a network gaming system or network gaming service. In one implementation, the virtual poker game can be implemented using FLASH®-based technologies. For example, the virtual poker game can be fully or partially implemented as a SWF object that is embedded in a web page and executable by a Flash® media player plug-in.

Particular embodiments may operate in a wide area network environment, such as the Internet, including multiple network addressable systems. FIG. 1 illustrates an example network environment, in which various example embodiments may operate. Network cloud 160 generally represents one or more interconnected networks, over which the systems and hosts described herein can communicate. Network cloud 160 may include packet-based wide area networks (such as the Internet), private networks, wireless networks, satellite networks, cellular networks, paging networks, and the like. As FIG. 1 illustrates, particular embodiments may operate in a network environment comprising one or more network gaming systems 120 and one or more client devices 130. Client devices 130 are operably connected to the network environment via a network service provider, a wireless carrier, or any other suitable means.

Network gaming system 120 is a network addressable system that, in various example embodiments, comprises one or more physical servers 122 and data store 124. The one or more physical servers 122 are operably connected to computer network 160 via, by way of example, a set of routers and/or networking switches 126. In an example embodiment, the functionality hosted by the one or more physical servers 122 may include web or HTTP servers, File Transfer Protocol (FTP) servers, as well as, without limitation, webpages and applications implemented using Common Gateway Interface (CGI) script, PHP Hyper-text Preprocessor (PHP), Active Server Pages (ASP), Hyper Text Markup Language (HTML), Extensible Markup Language (XML), Java, JavaScript, Asynchronous JavaScript and XML (AJAX), Flash, ActionScript, and the like.

Physical servers 122 may host functionality directed to the operations of network gaming system 120. Hereinafter servers 122 may be referred to as server 122, although server 122 may include numerous servers hosting, for example, network gaming system 120, as well as other content distribution servers, data stores, and databases. Data store 124 may store content and data relating to, and enabling, operation of the network gaming system 120 as digital data objects. A data object, in particular implementations, is an item of digital information typically stored or embodied in a data file, database or record. Content objects may take many forms, including: text (e.g., ASCII, SGML, HTML), images (e.g., jpeg, tif and gin, graphics (vector-based or bitmap), audio, video (e.g., mpeg), or other multimedia, and combinations thereof. Content object data may also include executable code objects (e.g., games executable within a browser window or frame), podcasts, etc. Logically, data store 124 corresponds to one or more of a variety of separate and integrated databases, such as relational databases and object-oriented databases, that maintain information as an integrated collection of logically related records or files stored on one or more physical systems. Structurally, data store 124 may generally include one or more of a large class of data storage and management systems. In particular embodiments, data store 124 may be implemented by any suitable physical system(s) including components, such as one or more database servers, mass storage media, media library systems, storage area networks, data storage clouds, and the like. In one example embodiment, data store 124 includes one or more servers, databases (e.g., MySQL), and/or data warehouses. Data store 124 may include data associated with different network gaming system 120 users and/or client devices 130.

Client device 130 is generally a computer or computing device including functionality for communicating (e.g., remotely) over a computer network. Client device 130 may be a desktop computer, laptop computer, personal digital assistant (PDA), in- or out-of-car navigation system, smart phone or other cellular or mobile phone, or mobile gaming device, among other suitable computing devices. Client device 130 may execute one or more client applications, such as a web browser (e.g., Microsoft Internet Explorer, Mozilla Firefox, Apple Safari, Google Chrome, and Opera, etc.) and plug-ins and/or other extensions (e.g., Flash® Media Player), to access content over a computer network. In other implementations, client device 130 may host a special-purpose client application that is specifically adapted to access network gaming system 120 in order to access a network game, such as a virtual poker game.

Figure 2:
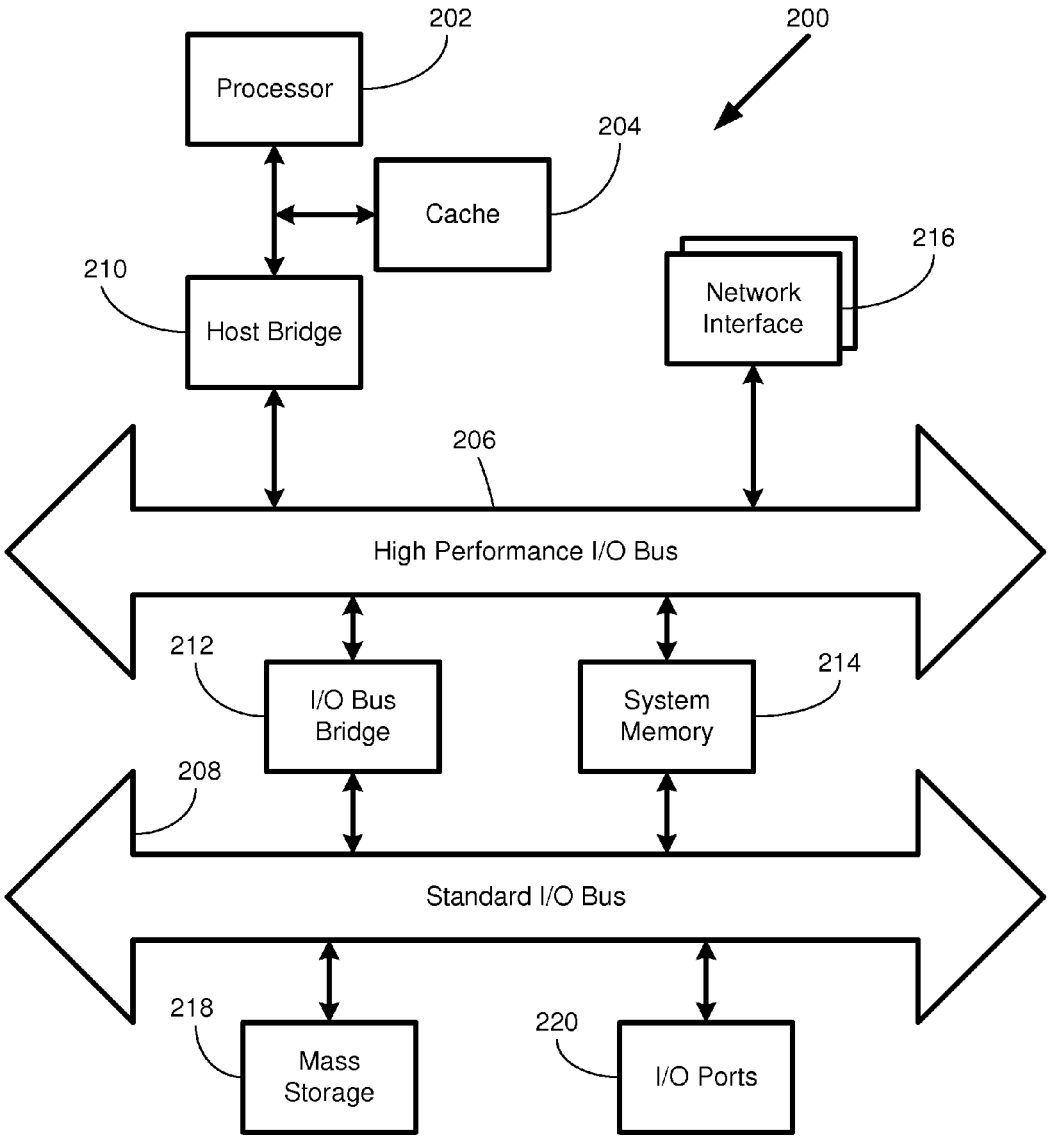
FIG. 2 illustrates an example computer system architecture.

FIG. 2 illustrates an example computing system architecture, which may be used to implement a server 122 or a client device 130. In one embodiment, hardware system 200 comprises a processor 202, a cache memory 204, and one or more executable modules and drivers, stored on a tangible (i.e., non-transitory) computer readable medium, directed to the functions described herein. Additionally, hardware system 200 may include a high performance input/output (I/O) bus 206 and a standard I/O bus 208. A host bridge 210 may couple processor 202 to high performance I/O bus 206, whereas I/O bus bridge 212 couples the two buses 206 and 208 to each other. A system memory 214 and one or more network/communication interfaces 216 couple to bus 206. Hardware system 200 may further include video memory (not shown) and a display device coupled to the video memory. Mass storage 218, and I/O ports 220 couple to bus 208. Hardware system 200 may optionally include a keyboard and pointing device, and a display device (not shown) coupled to bus 208. Collectively, these elements are intended to represent a broad category of computer hardware systems, including but not limited to general purpose computer systems based on the x86-compatible processors manufactured by Intel Corporation of Santa Clara, Calif., and the x86-compatible processors manufactured by Advanced Micro Devices (AMD), Inc., of Sunnyvale, Calif., as well as any other suitable processor.

The elements of hardware system 200 are described in greater detail below. In particular, network interface 216 provides communication between hardware system 200 and any of a wide range of networks, such as an Ethernet (e.g., IEEE 802.3) network, a backplane, etc. Mass storage 218 provides permanent storage for the data and programming instructions to perform the above-described functions implemented in servers 122, whereas system memory 214 (e.g., DRAM) provides temporary storage for the data and programming instructions when executed by processor 202. I/O ports 220 are one or more serial and/or parallel communication ports that provide communication between additional peripheral devices, which may be coupled to hardware system 200.

Hardware system 200 may include a variety of system architectures; and various components of hardware system 200 may be rearranged. For example, cache 204 may be on-chip with processor 202. Alternatively, cache 204 and processor 202 may be packed together as a "processor module," with processor 202 being referred to as the "processor core." Furthermore, certain embodiments of the present disclosure may not require nor include all of the above components. For example, the peripheral devices shown coupled to standard I/O bus 208 may couple to high performance I/O bus 206. In addition, in some embodiments, only a single bus may exist, with the components of hardware system 200 being coupled to the single bus. Furthermore, hardware system 200 may include additional components, such as additional processors, storage devices, or memories.

An operating system manages and controls the operation of hardware system 200, including the input and output of data to and from software applications (not shown). The operating system provides an interface between the software applications being executed on the system and the hardware components of the system. Any suitable operating system may be used, such as the LINUX Operating System, the Apple Macintosh Operating System, available from Apple Computer Inc. of Cupertino, Calif., UNIX operating systems, Microsoft® Windows® operating systems, BSD operating systems, and the like. Of course, other implementations are possible. For example, the functions described herein may be implemented in firmware or on an application specific integrated circuit.

Furthermore, the above-described elements and operations can be comprised of instructions that are stored on non-transitory storage media. The instructions can be retrieved and executed by a processing system. Some examples of instructions are software, program code, and firmware. Some examples of non-transitory storage media are memory devices, tape, disks, integrated circuits, and servers. The instructions are operational when executed by the processing system to direct the processing system to operate in accord with the invention. The term "processing system" refers to a single processing device or a group of inter-operational processing devices. Some examples of processing devices are integrated circuits and logic circuitry. Those skilled in the art are familiar with instructions, computers, and storage media.

Miscellaneous

One or more features from any embodiment may be combined with one or more features of any other embodiment without departing from the scope of the disclosure.

A recitation of "a", "an," or "the" is intended to mean "one or more" unless specifically indicated to the contrary.

The present disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend.

For example, the processes described herein may be implemented using hardware components, software components, and/or any combination thereof. By way of example, while embodiments of the present disclosure have been described as operating in connection with a networking website, various embodiments of the present disclosure can be used in connection with any communications facility that supports web applications. Furthermore, in some embodiments the term "web service" and "website" may be used interchangeably and additionally may refer to a custom or generalized Application Programming Interface (API) on a device, such as a mobile device (e.g., cellular phone, smart phone, personal GPS, personal digital assistance, personal gaming device, etc.), that makes API calls directly to a server. The specification and drawings are, accordingly, to be regarded in an illustrative rather than a restrictive sense. It will, however, be evident that various modifications and changes may be made thereunto without departing from the broader spirit and scope of the disclosure as set forth in the claims and that the disclosure is intended to cover all modifications and equivalents within the scope of the following claims.

What is claimed is:

1. A method for executing game transactions in an online game, the method comprising:

embedding a game board of a poker game within a webpage of a social networking site, wherein the game board includes:

a first icon of a first player playing the poker game;

one or more icons associated with for other players in the poker game;

an amount of virtual poker chips for the first player; and a user interface element for purchasing virtual items utilizing the virtual poker chips, wherein the virtual poker chips are used for betting in the poker game and for purchasing virtual items, wherein a first virtual item acquired in the poker game with virtual poker chips is associated with the first player in the poker game and associated with the first player in another online game different from the poker game; and rewarding the first player with additional virtual poker chips after completing a task, quest, challenge, or mission within the another online game, wherein at least one operation of the method is executed through a processor.

2. The method as recited in claim 1, wherein the user interface for purchasing includes an option for buying a virtual item for the first player.

3. The method as recited in claim 1, wherein the user interface for purchasing includes an option for buying a virtual item for one or more of the other players with virtual poker chips.

4. The method as recited in claim 1, wherein the other players are friends or otherwise connected to the first player within a context of an online social network.

5. The method as recited in claim 1, wherein the game board further includes:

a virtual poker table;

a virtual poker dealer;

cards the first player is holding;

amount of currency held by each player;

size of a bet of each player; and a size of a pot for a current hand of poker.

6. A method for executing game transactions in an online game, the method comprising:

embedding, within a webpage of a social networking site, a game board of a poker game, the game board including an option for selecting a gift shop for purchasing virtual items, wherein the gift shop includes a plurality of virtual items, each virtual item having an associated amount of virtual poker chips for a purchase, wherein the virtual poker chips are used for betting in the poker game and for purchasing virtual items;

receiving an input from a first player to purchase a first item from the plurality of virtual items, the input including a selection of whether to purchase the first item for the first player playing the game or purchase the first item for a second player socially linked to the first player in the online game;

debiting an account of the first player with the amount of virtual poker chips associated with the first item; and delivering the first item to the first player or to the second player, wherein the first item is associated with the first player in the poker game and associated with the first player in another online game different from the poker game, wherein at least one operation of the method is executed through a processor.

7. The method as recited in claim 6, wherein the first item stays associated with the first player in perpetuity.

8. The method as recited in claim 6, wherein the first item stays associated with the first player for a limited duration.

9. The method as recited in claim 1, wherein the game board of the poker game further includes:

a chat interface for players in the poker game.

10. The method as recited in claim 1, wherein the game board of the poker game includes an option to select a gift shop for purchasing the virtual items, wherein the game displays a gift shop user interface when the option to select the gift shop is selected.

11. The method as recited in claim 10, wherein the gift shop user interface further includes an option for buying virtual items for all players at the poker game.

12. The method as recited in claim 10, wherein the gift shop user interface further includes an option to purchase a drink, wherein a purchased drink is displayed in the game board of the poker game next to a player associated with the drink.

13. The method as recited in claim 10, wherein the gift shop user interface further includes an option to purchase a flag, wherein a purchased flag is displayed in the game board of the poker game next to a player associated with the flag.

14. The method as recited in claim 10, wherein the gift shop user interface further includes an option to purchase a cigarette or a cigar, wherein a purchased cigarette or cigar is displayed in the game board of the poker game next to a player associated with the cigarette or cigar.

15. The method as recited in claim 10, wherein the gift shop user interface further includes an option to purchase a food, wherein a purchased food is displayed in the game board of the poker game next to a player associated with the food.

* * * * *